United States Patent [19]

Arichi et al.

[11] Patent Number: 4,547,077

[45] Date of Patent: Oct. 15, 1985

[54] MODE SELECTION ARRANGEMENT FOR USE IN A TIMER

[75] Inventors: Isao Arichi, Kurashiki; Takuji Koh, Okayama; Isao Nanba, Kurashiki, all of Japan

[73] Assignee: Omron Tateisi Electronics Co., Kyoto, Japan

[21] Appl. No.: 595,166

[22] Filed: Mar. 30, 1984

[30] Foreign Application Priority Data

Mar. 30, 1983 [JP] Japan ..... 58-46001[U]
Mar. 30, 1983 [JP] Japan ..... 58-46002[U]

[51] Int. Cl.[4] ..... G04F 8/00; H01H 7/08

[52] U.S. Cl. ..... 368/107; 200/38 R; 307/141.4

[58] Field of Search ..... 368/107-113; 307/141 R, 141.4; 200/37 R, 37 A, 38 R, 38 A, 38 B

[56] References Cited

U.S. PATENT DOCUMENTS

| | | | |
|---|---|---|---|
| 3,329,781 | 7/1967 | Wiser | 307/141.4 X |
| 3,612,789 | 10/1971 | Marquis | 200/38 R X |
| 4,410,774 | 10/1983 | Houpt et al. | 368/107 X |
| 4,440,503 | 4/1984 | Arichi et al. | 368/107 |

*Primary Examiner*—Vit W. Miska
*Attorney, Agent, or Firm*—Wegner & Bretschneider

[57] ABSTRACT

A mode selection arrangement for use in a timer includes a gear box and a printed circuit board provided at the back of the gear box. Predetermined contact patterns are formed on a face of the printed circuit board facing the gear box. Rotatably provided in the gear box are display gears and switch gears. Each display gear has a plurality of indicia depicted on its face, and the corresponding switch gear rotates operatively or integrally with the display gear. A sliding contact member is fixedly attached to each switch gear, so that the sliding contact member slidingly contacts the corresponding contact pattern. A front plate having windows formed therein is provided to close the gear box so that the indicia are displayed through the windows.

8 Claims, 5 Drawing Figures

MODE SELECTION ARRANGEMENT FOR USE IN A TIMER

BACKGROUND OF THE INVENTION

1. Field of the invention

The present invention relates to a timer and, more particularly, to a mode selection arrangement for use in an electronic timer for selecting various counting modes, such as hour-counting mode, minute-counting mode, and second-counting mode, together with a scale change representing hour, minute or second, and various operation modes, such as on-delay mode, off-delay mode and program mode.

2. Description of the Prior Art

An electronic timer, which has been proposed lately, can operate under different modes by the change of internal circuit connection effected through a manual operation. According to one prior art, such a manual operation is done by a switch and, at the same time, a scale is replaced by another scale presenting the selected range. According to another prior art, such a manual operation is done by an insertion of a key which actuates the switch to change the range and carries an indication representing the selected range. The later is disclosed, for example, in British Patent Application Laid-Open Publication No. GB 2,085,202A (or a counterpart U.S. patent application Ser. No. 299,582 filed Sept. 4, 1981) assigned to the same assignee as this application.

In any of the prior art timers mentioned above, it is necessary to prepare more than one scale or one key, resulting in likelihood of losing parts, thus resulting in difficulty in maintenance. Furthermore, it is necessary to provide a number of switches corresponding to the number of different modes provided, resulting in high manufacturing cost and bulky in size, particularly the front operating panel portion.

Also, according to the prior art electronic timer, a sliding contact member defined by a comb shaped contact mounted on a rotator is provided such that the sliding contact member slides on a predetermined pattern of printed circuit.

This arrangement, however, has a poor contacting pressure between the contact member and the pattern, because the comb shaped contact is provided at the free end of the sliding contact member. If the contacting pressure is made stronger, it is likely that the sliding contact member rotates relatively to the rotator, when the rotator is rotated. This deteriorates the accuracy of positioning the sliding contact member.

SUMMARY OF THE INVENTION

The present invention has been developed with a view to substantially solving the above described disadvantages and has for its essential object to provide an improved mode selection arrangement for use in an electronic timer which has no additional parts, such as scales or keys.

It is also an essential object of the present invention to provide the mode selection arrangement of the above described type which can provide an adequate and stable contact pressure between the contact member and the pattern, and which can prevent the sliding contact member from being rotated relatively to the rotator, when the rotator is rotated.

It is also an essential object of the present invention to provide the mode selection arrangement of the above described type which is compact in size, particularly from the view point of thickness, and can readily be manufactured at a low cost.

In accomplishing these and other objects, a mode selection arrangement according to the present invention comprises a gear box and a printed circuit board provided adjacent the gear box. At least one predetermined contact pattern is formed on a face of the printed circuit board facing the gear box. Rotatably provided in the gear box are display gear means and switch gear means. The display gear means has a plurality of indicia depicted on its face, and the switch gear means rotates operatively or integrally with the display gear means. A sliding contact member is fixedly attached to the switch gear means, so that the sliding contact member slidingly contacts the contact pattern. A front plate having windows formed therein is provided to close the gear box so that the indicia are displayed through the windows.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENTS

Figure 2:
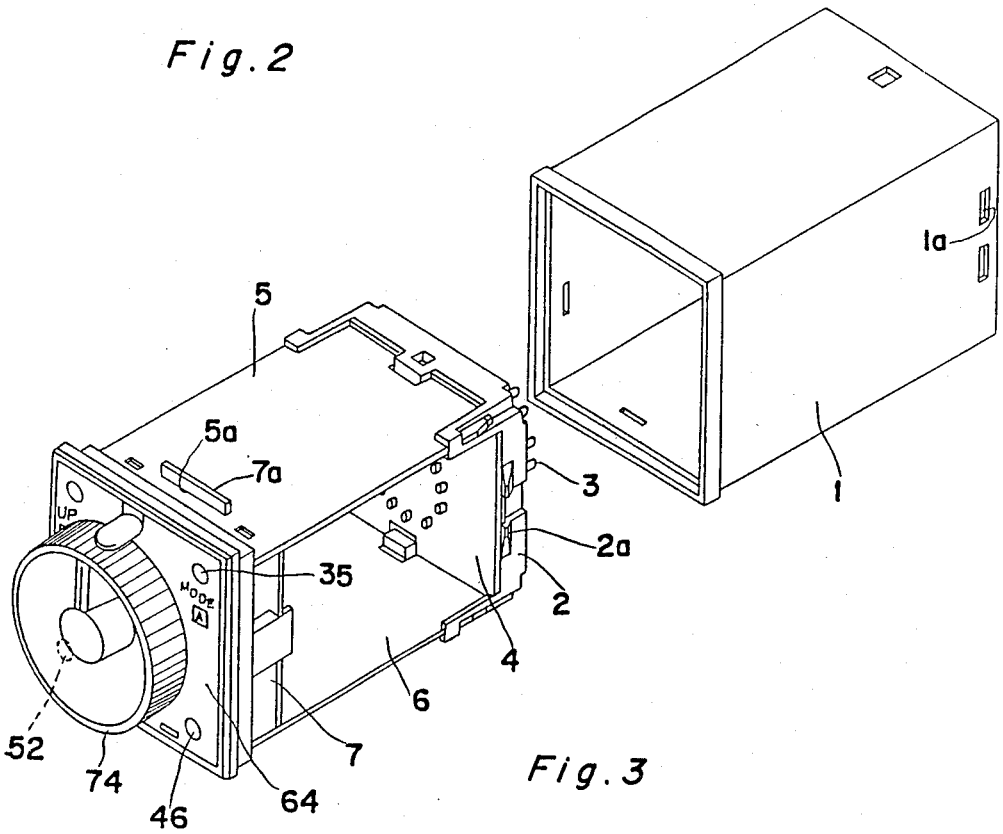
FIG. 2 is a perspective view of an electronic timer with a casing being removed for showing the mode selection arrangement of the present invention employed therein.
Figure 3:
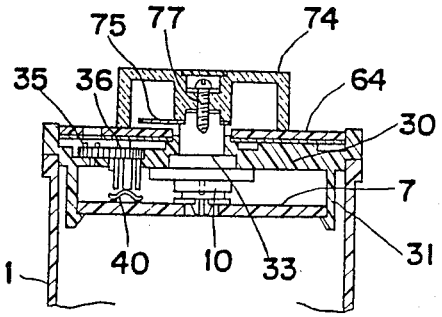
FIG. 3 is a cross-sectional view of the mode selection arrangement of the present invention.

Referring to FIG. 2, a reference numeral 1 designates a casing for an electronic timer, and 2 designates a base portion having a plurality of pins 3 mounted therein for the external connection. Base 2 has projections 2*a* which engage with slits 1*a* formed in casing 1 for fixedly attaching the case 1 to the base 2. A reference numeral 4 designates a printed circuit board fixedly provided on an inner face of the base 2 and reference numerals 5 and 6 designate printed circuit boards fixedly provided perpendicularly to the opposite sides of printed circuit board 4. The printed circuit boards 4, 5 and 6 are electrically connected with each other.

At front end portion of each of printed circuit boards 5 and 6, a slit 5*a* and 6*a* (6*a* can not be seen) is provided for the engagement with projections 7*a* and 7*b* extending from another printed circuit board 7. By a suitable connecting means, such as a soldering, printed circuit boards 5, 6 and 7 are also electrically connected with each other.

In a space defined by four printed circuit boards 4, 5, 6 and 7, an electronic timer arrangement of known type, such as described in British Patent Application Laid-Open Publication No. GB 2,085,202A, is installed.

Figure 1:
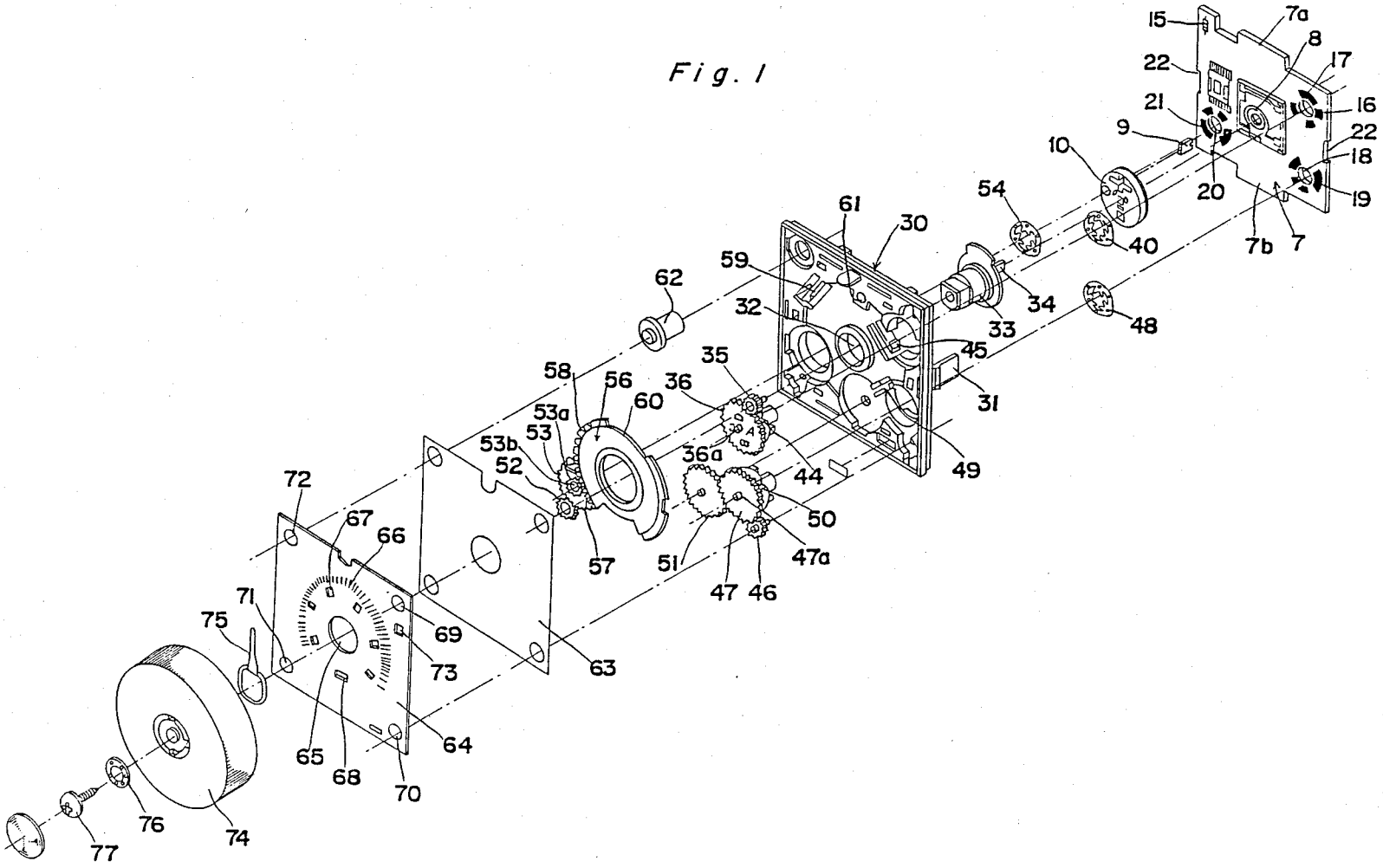
FIG. 1 is an exploded view of a mode selection arrangement for use in an electronic timer according to a preferred embodiment of the present invention.

Referring to FIG. 1, the printed circuit board 7 has a ring pattern of resistive element 8 deposited at the center of its front surface. A rotator 10 carrying a contact member 9, which constantly contacts the resistive element 8, is rotatably mounted on the front surface of the printed circuit board 7. Furthermore, the printed circuit board 7 has, around its peripheral portion, three contact patterns 17, 19 and 21 formed around circle openings 16, 18 and 20, respectively, and an indication lamp 15. The pattern 17 is provided for the change of operation modes, such as on-delay mode, off-delay mcde and program mode. The pattern 19 is provided for the change of counting (or range) modes, such as hour-counting mode, minute-counting mode, and second-counting mode. The pattern 21 is provided for the change of numbers on the scale.

A gear box 30 made of synthetic resin is provided in front of and spaced from the printed circuit board 7 such that a pair of arms 31 extending rearwardly from opposite sides of the gear box 30 fittingly engages with recesses 22 formed at opposite sides of the printed circuit board 7. The gear box 30 has a circle opening 32 formed at the center thereof for rotatably receiving knob axle 33 from the rear face of the gear box 30. The knob axle 33 has a projection 34 extending rearwardly for the engagement with the rotator 10. Thus, the knob axle 33 rotates together with the rotator 10.

Figure 4:
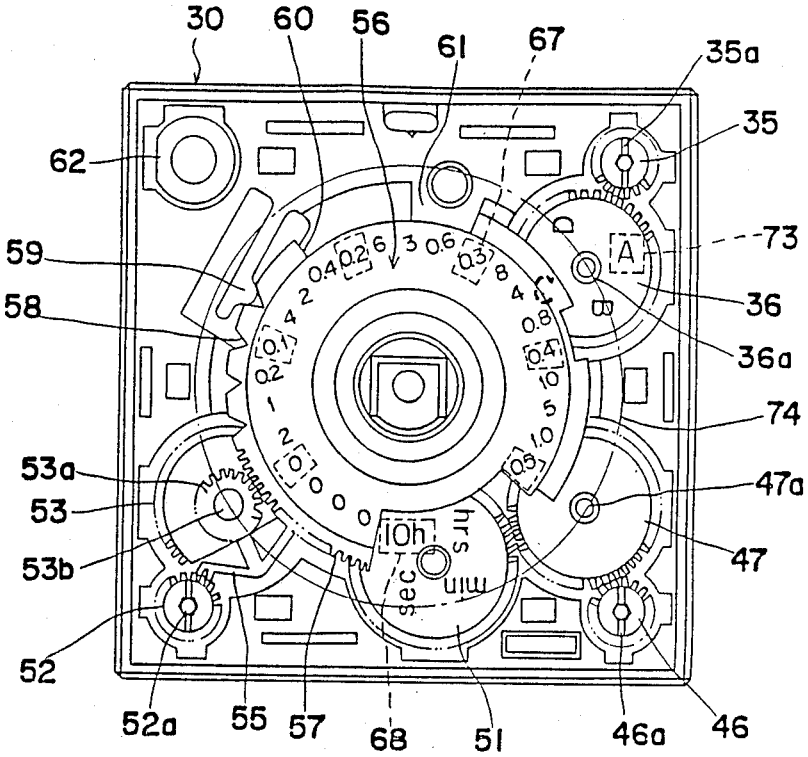
FIG. 4 is a front view of the mode selection arrangement of the present invention, with a front plate being removed.

An input gear 35 for effecting the change of operation mode is rotatably supported in the gear box 30. As best shown in FIG. 4, input gear 35 is formed with a groove 35*a* on its front face in a diameter direction. A switch gear 36, which engages with input gear 35, has a shaft 44 which extends rearwardly through the gear box 30 and is rotatably supported by opening 16 provided in circuit board 7. A sliding contact member 40 is fixedly attached to the rear face of the switch gear 36 so that sliding contact member 40 slides on the contact pattern 17 in accordance with the rotation of the switch gear 36. A manner in which the sliding contact member 40 is attached to the switch gear 36 is described below.

Figure 5:
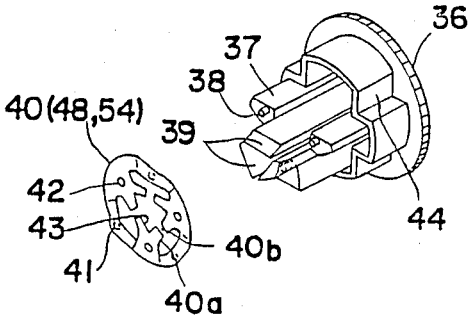
FIG. 5 is a perspective view of a switch gear and a sliding contact member.

Referring particularly to FIG. 5, the switch gear 36 has three stems 37 projecting rearwardly, each stem having a nipple 38 at the rear end. Within a space defined by three stems 37, the walls 39 extend parallel to the stems in a shape of triangle, when viewed directly from the back. Each wall has its free end slanted as shown, and has some degree of flexibility. Furthermore, switch gear 36 has an outer wall formed with four indents 44 which are spaced 90° from each other.

The sliding contact member 40 is formed by a thin layer of metal cut out in a shape of a circle, and its perimeter is so waved as to provide three peak points equally spaced from each other. A rounded point 41 is formed at each peak point by, e.g., an ejection procedure. A circuit opening 42 is formed at three places between the peak points. The center of the sliding member 40 is formed with a triangle opening 43. Each side of the triangle opening 43 has a slit 40*b* which extends to an oval opening 40*a*. The slit 40*b* and oval opening 40*a* are provided to prevent the triangle opening 43 from being deformed when the thin layer metal is press cut to form the triangle opening 43.

The sliding contact member 40 is mounted on the switch gear 36 such that three walls 39 are fittingly inserted into the triangle opening 43 of the sliding contact member 40, and nipples 38 are inserted into circle openings 42. Thereafter, nipples 38 may be deformed by the application of heat to ensure the attachment of sliding contact member 40 to switch gear 36.

Referring back to FIG. 1, four indents 44 formed in switch gear 36 engage in a ratchet operated manner with a pawl 45 provided in gear box 30 so that switch gear 36 is held in a position after each quarter turn. The switch gear 36 has a projection 36*a* extending forwardly from the center of its front face. Also, the front face of the switch gear is depicted with four different indications, such as, "A", "B", "C" and "D", representing four different modes of operation. Thus, the switch gear 36 also serves as an indicator.

A reference numeral 46 is also an input gear, but is provided for effecting the change of time range, such as hour, minute, and second. Input gear 46 engages with a switch gear 47. Input gear 46 and switch gear 47 are arranged in the same manner as the input gear 35 and switch gear 36 described above, such that input gear 46 has a groove 46*a* (FIG. 4) formed on its front face, whereas switch gear 47 is so arranged as to receive a sliding contact member 48. Furthermore, switch gear 47 has a projection 47*a* formed at the center of its front face, and at its back, four indents 50 are provided. The indents engage in a ratchet operated manner with a pawl 49 provided in gear box 30. Sliding contact member 48 slides on contact patter 19. Switch gear 47 further engages with a display gear 51 which has four different indications, such as "10h", "hrs", "min" and "sec" (FIG. 4) depicted on its front face.

A reference numeral 52 designates another input gear, but is provided for effecting the change of numbers on a scale. The input gear 52 also has a groove 52*a* (FIG. 4) formed on its front face, and is provided to engage with a switch gear 53. In the same manner as the above-described switch gear 36, switch gear 53 is provided with a sliding contact member 54 which slides on a contact pattern 21. Unlike other switch gears 36 and 47, switch gear 53 is integrally provided with a reduction gear 53*a* coaxially on its front face, and a projection 53*b* is formed at the center of the front face of reduction gear 53*a*. Furthermore, as shown in FIG. 4, switch gear 53 has a flexible arm 55 carrying gear-teeth at its end so as to restrict the degree of rotation of switch gear 53 within a limited degree. More particularly, when input gear 52 is so rotated as to engage with the gear-teeth on flexible arm 55, the gear-teeth are pushed towards the axis of gear 53, thereby failing to transmit the driving force of input gear 52 to switch gear 53.

As best shown in FIG. 4, the reduction gear 53*a* engages with a display gear 56 which is rotatably provided at the center of the gear box 30. There are numbers depicted around on the front face of display gear 56. Display gear 56 is formed with a plurality of, such as four, indents 58 around its periphery for the engagement in a ratchet operated manner with a pawl 59 provided in gear box 30 so that display gear 56 is held in a position after each certain degree of rotation. Formed next to the indents 58 is a cut-out recess 60 in to which a stop 61 extends from gear box 30, thereby restricting the degree of rotation of display gear 56 within a predetermined degree, such as 40 degrees.

Referring back to FIG. 1, a reference numeral 62 is a lamp cover which is pressure fitted into an opening formed at the top left corner of the gear box 30, and is provided in an alignment with indication lamp 15. A front plate 64 is provided for closing the gear box 30. According to a preferred embodiment, a transparent sheet 63 is provided before placing the front plate 64 so as to keep dust away from the gear box 30 and, at the same time, to provide a smooth contact with the tip of each of projections 36*a*, 47*a* and 53*b*. Front plate 64, as well as transparent sheet 63, has a circle opening 65 formed at its center for receiving knob axle 33. Provided around the center opening 65 of front plate 64 is a scale 66 accompanying six windows 67 for the display of numbers for the scale 66. Such numbers are depicted on display gear 56. Formed below the center opening 65 is a window 68 for the display of a range depicted on display gear 51. Provided at the periphery of the front plate 64 are five openings 69, 70, 71, 72 and 73. Opening 72 is formed in alignment with the lamp cover 62 so that on and off of lamp 15 can be viewed thereat, and opening 73 formed for the display of selected mode of operation from four different modes depicted on display gear 51.

Opening 69 is formed in alignment with the axis of input gear 35 so that a screw driver can be inserted through opening 69 to engage with groove 35*a*, thereby effecting the rotation of the input gear 35. Similarly, opening 70 is formed in alignment with the axis of input gear 46 and opening 71 is formed in alignment with the axis of input gear 52 so that input gear 46 or 52 can be turned by the use of a screw driver inserted through respective opening.

In front of front plate 64, a needle 75 and a knob 74 are provided, which are fixedly mounted on knob axle 33 by the use of a screw 77 and a washer 76. By tightening the screw 77 into the screw hole formed in knob axle 33, knob 74 is held against front plate 64, and front plate 64 is held against gear box 30. Thus, the gears are held and maintained in gear box 30 by a single screw 77. A suitable cover is provided on knob 74 to conceal the head of screw 77.

According to a preferred embodiment, knob 74 is made of a transparent material and has such a diameter that its perimeter is located, as shown in FIG. 4, over projections 36*a*, 47*a* and 53*b*. Thus, switch gears 36, 47 and 53 are prevented from being undesirably moved frontwardly in the axial direction as effected in such a case as when front plate 64 is not completely flat. Furthermore, the pushing force of projections 36*a*, 47*a* and 53*b* against the front plate 64, in the case if the spring effect of sliding contact members 40, 48 and 54 are stronger than the required, may result in the deformation of front plate 64. But can be prevented if the above-described arrangement of knob 74 is employed. Instead of the above, the knob 74 can take any other diameter, such as one slightly greater than the circle opening 65. In this case, the knob 74 can be formed by a non-transparent material.

The mode selection arrangement described above is assembled in the following steps. First, the input gears, switch gears and display gears are placed in gear box 30 from front. Then, transparent sheet 63 and front plate 64 are fittingly place on gear box 30. And, knob 74 and knob axle 33 are fixedly connected with each other using screw 77, and thus to gear box 30. Thereafter, gear box 30 is placed up-side-down to fixedly attach sliding contact members 40, 48 and 54 to respective switch gears 36, 47 and 53. Then, printed circuit board 7 is pressure fitted between arms 31 to be installed on the back of gear box 30.

The mode selection arrangement according to the present invention operates in the following manner.

By the use of a screw driver, or the like, one or more of input gears 35, 46 and 52 is rotated. When input gear 35 is rotated, switch gear 36 rotates to change the contact condition of sliding contact member 40 on contact pattern 17. Also, the rotation of switch gear 36 changes the display of operation mode through window 73, such as to mode "A", as illustrated in FIG. 4. When input gear 46 is rotated, switch gear 47 rotates to change the contact condition of sliding contact member 48 on contact pattern 19 and, at the same time, display gear 51 rotates to change the display of range such as to "10h", as illustrated in FIG. 4. Similarly, when input gear 52 is rotated, switch gear 53 rotates to change the contact condition of sliding contact member 54 on contact pattern 21 and, at the same time, display gear 56 rotates to change the display of numbers for the scale 66 such as to "0", "0.1", "0.2", "0.3", "0.4" and "0.5", as illustrated in FIG. 4.

Since switch gears 36 and 47 and display gear 56 are rotated to stable positions by the ratchet arrangement, the gears will not be rotated undesirably, for example, by the vibration or impact, thereby facilitating the setting of desired mode and maintaining the selected mode unless the input gear or gears is forcibly rotated by the driver.

After setting the various modes in the above-described manner, knob 74 is rotated, thereby rotating the rotator 10. Thus, contact member 9 slides on the resistive element 8 to set the desired time length.

It is to be noted that contact patterns 17, 19 and 21 and resistive element 8 are electrically connected to timer arrangement (not shown) provided behind the printed circuit board 7.

According to the present invention, the gear arrangement in gear box 30 can be so changed as to increase or decrease the number of set of gears depending on the number of modes to be changed. For example, the modes, which has been described as three, can be reduced to one. Furthermore, the input gears can be eliminated. In this case, the switch gears and display gears are so arranged as to be directly turned by a screw driver, or the like.

Furthermore, according to the present invention, instead of using a screw driver, a suitable knob can be connected to each input gear to effect its rotation.

According to the present invention, since a sliding contact member, which slides on a contact pattern on the printed circuit board, is mounted on a gear, no separate switch arrangement is necessary for the change of modes. Thus, the mode selecting arrangement according to the present invention can be arranged in thin and compact size with a low manufacturing cost. Furthermore, since the numbers for the scale can be changed, no separate parts, such as separate scales or separate keys is necessary. Moreover, since gear box 30 is provided to support other parts, such as front plate 64 and printed circuit board 7, no base plate is necessary.

Furthermore, according to the present invention, since perimeter of each sliding contact member is waved with the contact points formed at each peak point, the contact points can be depressed against the contact pattern with a predetermined contact pressure. Moreover, since the contact points are equally spaced from each other around the perimeter of the sliding contact member, the contact points can be provided with sufficient and stable contact pressure no matter what position the sliding contact member is rotated.

Furthermore, since the sliding contact member has a positioning opening formed at its center, and such a positioning opening fittingly engages with a projection extending from the switch gear, the sliding contact member will not slide relatively to the switch gear even when the contact pressure is made stronger. Thus, the contact between the contact points and contact patterns can be effected with a high accuracy. Moreover, since the positioning opening has a slit which extends to a neighboring opening, such as oval opening 40*a* described above, the positioning opening can be formed with a high accuracy through the press cut.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of appended claims.

What is claimed is:

1. A mode selection arrangement for use in a timer for selecting various modes comprising:

a gear box;

a printed circuit board provided adjacent said gear box;

at least one predetermined contact pattern formed on a face of said printed circuit board facing said gear box;

display gear means provided rotatably in said gear box, said display gear means having a plurality of indicia depicted on its face;

switch gear means having a shaft extending through said gear box for rotatably mounting said switch gear means in said gear box, said switch gear means rotating operatively or integrally with said display gear means;

a sliding contact member fixedly attached to said switch gear means, said sliding contact member being formed by a thin layer of metal substantially shaped as a circle, the circumference of the sliding contact member having an undulating wave shape as to provide a plurality of peak points equally spaced one from the other, a contact point being formed at each peak of said wave, said sliding contact member having an engagement opening formed at the center thereof for being mounted on said shaft of said switch gear means, said engagement opening having at least one slit extending therefrom; and a front plate provided to close said gear box, said front plate having at least one window formed therein for the display of said indicium through said window.

2. An arrangement as claimed in claim 1, wherein said shaft and said engagement opening have the same polygonal configuration.

3. An arrangement as claimed in claim 1, further comprising an input gear means provided rotatably in said gear box and engaged to said switch gear means, for effecting the rotation of said switch gear means.

4. An arrangement as claimed in claim 1, wherein said switch gear means has a groove formed therein for the engagement with a driver.

5. An arrangement as claimed in claim 1, further comprising a transparent sheet inside said gear box and tightly attached to said front plate.

6. An arrangement as claimed in claim 1, further comprising a knob axle rotatably inserted through an opening formed in said gear box and a knob fixedly connected to said knob axle such that said gear box and front plate are tightly held between said knob axle and knob.

7. An arrangement as claimed in claim 6, wherein said knob is made of transparent material.

8. An arrangement as claimed in claim 6, wherein said knob axle is coupled to an rotator carrying a contact member, and wherein said printed circuit board has a resistor pattern on which said contact member slides.

* * * * *